United States Patent [19]

Küppenbender

[11] 4,388,151

[45] Jun. 14, 1983

[54] METHOD AND DEVICE FOR FEEDING PURGING AND DEGRAPHITIZING AIR INTO COKE OVENS

[75] Inventor: Rainer Küppenbender, Ratingen, Fed. Rep. of Germany

[73] Assignee: Krupp-Koppers GmbH, Essen, Fed. Rep. of Germany

[21] Appl. No.: 294,167

[22] Filed: Aug. 19, 1981

[30] Foreign Application Priority Data

Aug. 20, 1980 [DE] Fed. Rep. of Germany ..... 3031329

[51] Int. Cl.[3] ..... C10B 5/02; C10B 21/04; C10B 43/10

[52] U.S. Cl. ..... 201/2; 201/41; 202/139; 202/141; 202/151; 202/241

[58] Field of Search ..... 201/2, 41; 202/138–146, 151, 241, 242, 247, 248, 269, 270

[56] References Cited

U.S. PATENT DOCUMENTS

| | | | |
|---|---|---|---|
| 1,435,361 | 11/1922 | Wilputte | 202/241 |
| 3,344,039 | 9/1967 | Nestler | 202/141 |
| 3,751,342 | 8/1973 | Gidick | 202/141 |
| 3,963,582 | 6/1976 | Helm et al. | 202/144 |
| 4,085,008 | 4/1978 | Kinzler | 202/151 |
| 4,093,519 | 6/1978 | Pries | 202/142 |

FOREIGN PATENT DOCUMENTS

| | | | |
|---|---|---|---|
| 1063369 | 9/1959 | Fed. Rep. of Germany | 202/241 |

*Primary Examiner*—Bradley Garris
*Attorney, Agent, or Firm*—Michael J. Striker

[57] ABSTRACT

A method and a device for feeding purging and degraphitizing air into pipes for rich gas leading to the heating walls of coke ovens. In the device a first cross-sectional opening is connected to a pipe for rich gas. This opening can be opened and closed with a first gate and is adapted to initially release only a relatively small cross-sectional aperture for passing purging air therethrough. A second cross-sectional opening is provided in the device, which is connected to the pipe for rich gas. The second opening can be opened and closed with a second gate and is adapted to release successively, with a time delay after the first cross-sectional opening, a relatively larger cross-section for passing degraphitizing air therethrough. An exchangeable screen can be placed in the aperture in the first cross-sectional opening. The degraphitizing air enters the pipe for burning off the graphite deposits resulting from the rich gas.

The device and method prevent deflagrations caused by feeding inaccurate amounts of purging air into the pipe for rich gas.

9 Claims, 2 Drawing Figures

METHOD AND DEVICE FOR FEEDING PURGING AND DEGRAPHITIZING AIR INTO COKE OVENS

BACKGROUND OF THE INVENTION

1. Field of the Invention

The present invention relates to a device for feeding of purging, flushing and degraphitizing air to the pipes for rich gas running to individual heating walls of coke ovens, where there is to be provided initially the release of a comparably small cross-section aperture for the purging air and successively the release of a larger cross-section aperture for the degraphitizing air.

2. Brief Description of the Background of the Invention Including Prior Art

Purging air serves as is known for removal of amounts of residual gas still in the pipe after shut-off of the feeding of rich gas. The thereafter fed degraphitizing air is to effect a burning off of the graphite deposits formed in the nozzles for rich gas and in the pipe for rich gas. However, it is in this context required to adjust accurately the amount of purging and flushing air in order to avoid deflagrations of inflammable and/or explosive mixtures.

In conventional devices of this kind a box-shaped provision is attached to the pipe for rich gas or respectively to an air feeding pipe connected to the pipe for rich gas, which box-shaped provision is provided with a flap. Usually this flap is connected via a chain to a rod system, which can be moved in a longitudinal direction actuated by an actuating provision (hydraulic jack or the like). In a first motion of the rod system thereby the flap is lifted up by an exactly preset amount and thereby releases the opening cross-section for the purging air required. In a later further motion of the rod system the flap is then completely lifted such that the full cross-section is available for the flowing in of degraphitizing air. The closing of the flap is provided by an opposite motion of the rod system and by the self-weight of the flap after termination of the degraphitizing process.

It has now been found that in the course of the operation of the coke oven battery there are frequently changes in the length of the rod system based on the variations in temperature. The changes in the length lead frequently to changes in the aperture width of the flap and as a result deviations in the amount of purging air occur. This can lead to the deflagrations mentioned above, which, unless readjustments are provided in time, result in leaks or thrown out nozzles.

SUMMARY OF THE INVENTION

1. Purposes of the Invention

It is an object of the present invention to provide a device assuring that independent of possible changes in length of a rod system always the same amount of purging air is available.

It is a further object of the present invention to provide a device for purging air, which helps avoiding deflagrations during the flushing of pipes for rich gas.

It is a further object to provide a safe method for the purging and degraphitizing of pipes for rich gas.

These and other objects and advantages of the present invention will become evident from the description which follows.

2. Brief Description of the Invention

The present invention provides a device for feeding purging and degraphitizing air into pipes for rich gas leading to the heating walls of coke ovens. A first cross-section opening is connected to the pipe for rich gas and the opening can be closed and opened with a first gate and is capable of initially releasing a relatively small aperture cross-section for passing purging air. A second cross-section opening is also connected to the pipe for rich gas and can be closed and opened with a second gate and is capable of releasing successively after the first cross-section opening has been opened a relatively larger cross-section aperture for passing degraphitizing air.

An exchangeable screen can be placed in the opening of the first cross-section and possibly in the opening of the second cross-section. There can further be provided a rod system connected to the first and to the second gate, where the opening motion of the rods required is larger for the second gate as compared to the opening motion for actuating the first gate.

Preferably there is provided a chain system connected to the first gate and to the second gate, where the opening motion required of the chain is larger for the second gate as compared to the opening motion for actuating the first gate. There can further be provided a rod actuating the chain system as well as pulleys supporting the chain system. Auxiliary weights can be attached to the gates for maintaining the gas pressure during the heat-up phase of the coke oven.

In one aspect of the present invention there is provided a method for feeding purging and/or degraphitizing air into a coke oven with heating walls. The pipe for rich gas can be expanded to a box-shaped enlargement. Two openings for gas such as air can be provided at the box-shaped enlargement and each opening can be covered with a separate gate. Preferably, the first opening and the second opening are disposed as seats at the box-shaped enlargement to provide a tight fit for the corresponding gates. Rich gas can be fed to the heating walls of the coke oven and this stream of rich gas can be interrupted. Then a first gate can be opened by a first motion of a mechanical transmission for allowing purging air to enter the pipe for rich gas and a second gate can be opened by a second motion of a mechanical transmission for allowing degraphitizing air to enter the pipe for rich gas.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

In the accompanying drawings, in which is shown one of the various possible embodiments of the present invention.

DESCRIPTION OF INVENTION AND PREFERRED EMBODIMENTS

In accordance with the present invention two cross-sections capable of being shut-off with flaps or gates are being provided for the passage of purging air or degraphitizing air, which open successively in time with an adjustable time interval in between. In accordance with a further feature of the invention the initially opening gate serves for the purging air in conjunction with an exchangeable screen. The flaps or gates are advantageously connected with chains or with a rod system in conventional manner, and the degraphitizing air gate opens with a time delay as compared with the gate for the purging air.

The method of the present invention achieves that the gate for the purging air is first actuated and is opened substantially completely, where temperature induced deviations of the lifting of the gate can be disregarded. By way of the available and by the gate released opening in any case the by way of the aperture cross-section determined amount of air can stream into the pipe for rich gas without variations in quantity. This way the formation of inflammable or explosive mixtures as well as the thereby caused deflagrations can be prevented effectively. By way of the exchangeable screen the required amount of purging air can be changed at any time if required.

After passage of the time provided for the purging of the pipe for rich gas, the rods are further actuated and the mechanics of the opening only now provide for releasing the gate for the degraphitizing air. Thereby the gate for the purging air can be further opened wider, without substantial change of the amount of air streaming in, which air now also serves to aid the degraphitizing process.

Figure 1:
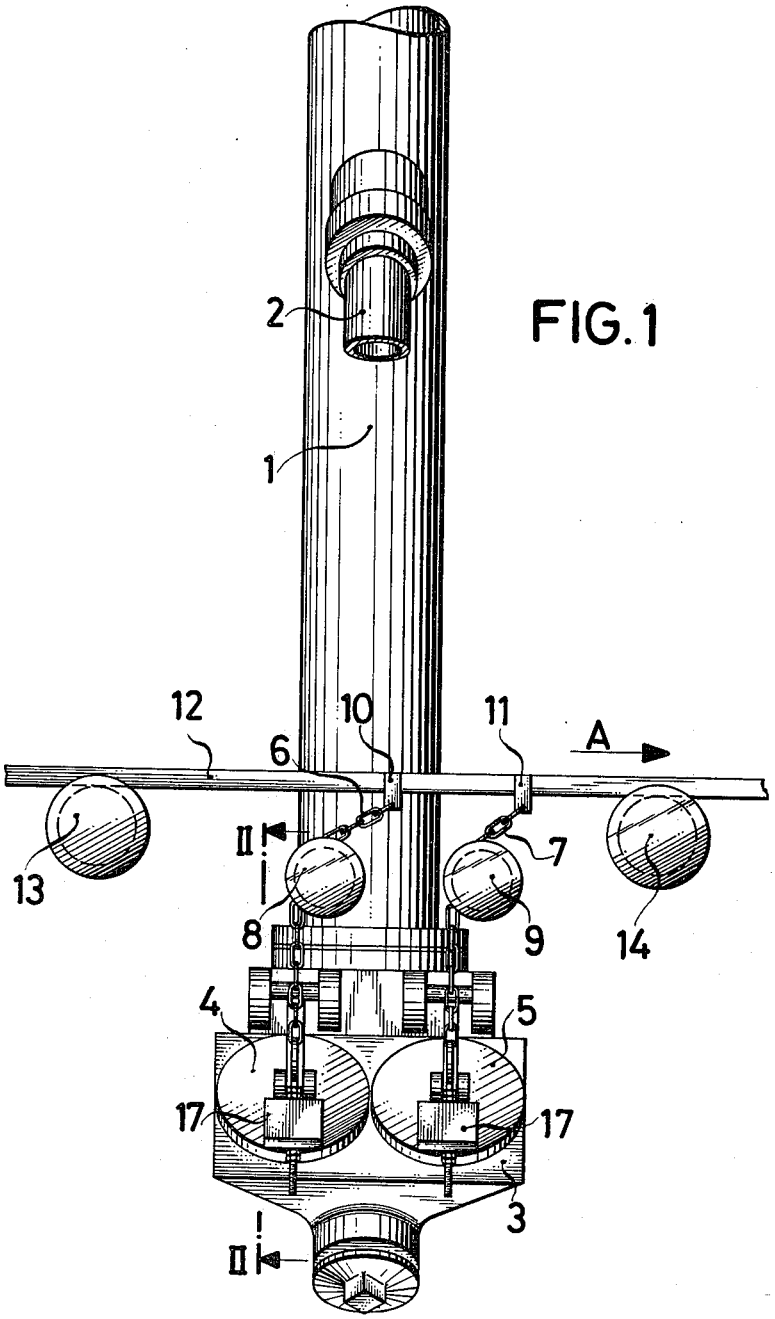
FIG. 1 is an elevational view of the device of the present invention.

Referring now to FIG. 1 there is shown the air feed pipe 1 and the pipe 2 for the rich gas, which is connected to the air feed pipe and which runs initially to the corresponding heating wall not shown here. A box-shaped provision 3 is disposed at the lower end of the air feed pipe. The provision 3 can be provided as a welded or as a cast construction. The box-shaped provision 3 is provided in the embodiment shown with two gates 4 and 5, of which the gate 4 is provided for the purging air and of which gate 5 is provided for the degraphitizing air. Chains 6 and 7 engage the respective gates. The chains 6 and 7 run over chain guide pulleys 8 and 9 and are connected at positions 10 and respectively 11 to a rod system 12. This rod system is supported by support and guide rolls 13 and 14 and can be moved in a longitudinal direction by way of an actuating mechanism not shown here. The disposition and guiding of the chains 6 and 7 are provided such that upon motion of the rod system 12 in the direction of the arrow A initially the gate 4 opens and based on the longer chain only upon further motion of the rod system 12 the gate 5 is lifted successively.

Figure 2:
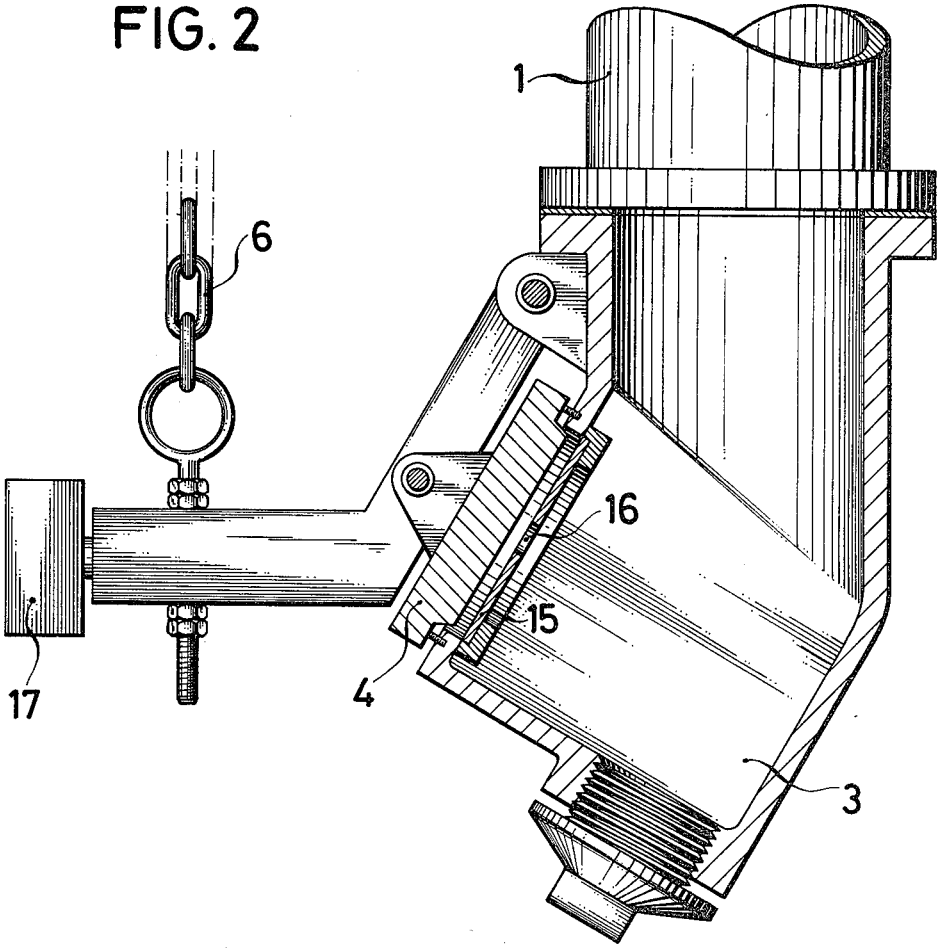
FIG. 2 is a partailly sectional view of the embodiment of FIG. 1 along section line II—II of FIG. 1.

It can be recognized from FIG. 2, that the gate 4 closes an exchangeable screen 15, the aperture 16 of which is adapted to the required amount of purging air. The gate 4 as well as the gate 5 cooperate with a seal inserted into the the box-shaped provision 3. The gates together with corresponding seats provide a substantially gas-tight closure. In order to provide an assured sealing against the gas pressure prevailing during the heating phase, the gates are preferably provided with auxiliary weights 17.

It will be understood that each of the elements described above, or two or more together, may also find a useful application in other types of system configurations and purging and burning-off procedures differing from the type described above.

While the invention has been illustrated and described as embodied in the context of a heating wall of a coke oven, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for feeding purging and degraphitizing air into coke ovens with heating walls, comprising:

a pipe for rich gas leading to each of the heating walls;

a first gate;

a first cross-sectional opening connected to the pipe for rich gas arranged and constructed to be opened and closed with the first gate and having a relatively small cross-sectional aperture for passing purging air therethrough;

a second gate;

a second cross-sectional opening connected to the pipe for rich gas arranged and constructed to be opened and closed with the second gate and having a relatively large cross-section for passing degraphitizing air therethrough; and wherein said gates and openings are arranged and constructed such that purging air flows through said first cross-sectional opening before degraphitizing air flows through said second cross-sectional opening.

2. The device for feeding air according to claim 1, further comprising an exchangeable screen placed in the first cross-sectional opening.

3. The device for feeding air according to claim 1, further comprising a rod system connected to the first gate and to the second gate, wherein the opening motion of the rod system is larger for actuating the second gate as compared to the opening motion for actuating the first gate.

4. The device for feeding air according to claim 1, further comprising a chain system connected to the first gate and to the second gate, wherein the opening motion of the chain system is larger for actuating the second gate as compared to the opening motion for actuating the first gate.

5. The device for feeding air according to claim 4, further comprising a rod for actuating the chain system.

6. The device for feeding air according to claim 4, further comprising pulleys for supporting the chain system.

7. The device for feeding air according to claim 1, further comprising auxiliary weights attached to the gates for maintaining the gas pressure during the heat up phase.

8. The device for feeding air according to claim 1, further comprising a box-shaped enlargement of the pipe for rich gas;

a first seat disposed at the box-shaped enlargement and providing the first cross-sectional opening; and a second seat disposed at the box-shaped enlargement and providing the second cross-sectional opening.

9. A method for feeding purging and degraphitizing air into a coke oven with heating walls, comprising:

expanding a pipe for rich gas to a box-shaped enlargement;

providing two openings for air at the box-shaped enlargement, each opening covered with a separate gate;

feeding rich gas to the heating walls of the coke oven;

interrupting the stream of rich gas;

actuating the one gate by a first motion of a mechanical transmission for allowing purging air to enter the pipe for purging the rich gas; and actuating the other gate by a second motion of said mechanical transmission for allowing degraphitizing air to enter the pipe for burning off the graphite deposits resulting from the rich gas.

* * * * *